United States Patent [19]

Hoppe

[11] 3,930,374

[45] Jan. 6, 1976

[54] DYNAMIC BALLAST AND STABILIZATION SYSTEM

[76] Inventor: Charles W. Hoppe, 24482 Glen Orchard, Farmington Hills, Mich. 48024

[22] Filed: Mar. 6, 1975

[21] Appl. No.: 556,003

[52] U.S. Cl. ..... 61/46.5; 61/19; 114/.5; 114/144 B; 415/122 R

[51] Int. Cl.[2] ..... E02D 21/00; E02B 17/00

[58] Field of Search ..... 61/46.5, 63, 19, 20; 114/144 B, .5 D; 415/122 R

[56] References Cited

UNITED STATES PATENTS

| | | | |
|---|---|---|---|
| 1,879,812 | 9/1932 | Miller | 415/122 R X |
| 3,553,968 | 1/1971 | Armistead | 61/46.5 |
| 3,588,796 | 6/1971 | Armistead | 114/144 B X |
| 3,733,834 | 5/1973 | Ludwig | 61/46 |

*Primary Examiner*—Jacob Shapiro
*Attorney, Agent, or Firm*—Basile and Weintraub

[57] ABSTRACT

The invention concerns dynamic ballast and stabilization systems for deep-sea applications such as the dynamic anchoring and stabilizing of off-shore platform structures supported by an elongated structure of the type having the lower ends fastened into the floor of a body of water. The system employs a relatively large impellor assembly which generates a downward vertical thrust of sufficient magnitude as to maintain the platform anchored. The structure is designed to absorb shock and movement within a prescribed range to cushion and protect operating equipment. The impellor is enclosed in a movable slinger which can control the lateral direction of the impellor generated thrust such that lateral displacement of the structure is counteracted by the underwater reactive force generated by the impellor. This system includes means for converting the flow of seawater into usable power for driving the system.

8 Claims, 2 Drawing Figures

DYNAMIC BALLAST AND STABILIZATION SYSTEM

BACKGROUND OF THE INVENTION

I. Field of the Invention

The present invention relates to dynamic ballast and stabilization systems for deep-sea applications, and, in particular, the present invention relates to a dynamic ballast and stabilization system for off-shore platform structures.

II. Description of the Prior Art

To be both practical and useful, off-shore platforms utilized for the exploration and production of crude oil and gas sources must not only perform a desired function but do so under adverse operating conditions. Primarily among such conditions is a virtually unpredictable source of trouble at any off-shore platform by the continuously changing pattern of wave intensity which reflects widespread weather conditions. For example, weather situations in one part of the world may have a decided effect on the water and wave conditions in a remote section thousands of miles away. In the design and construction of off-shore platforms most weather conditions can be accounted for through the expediency of fabricating the platform of sufficient strength to satisfactorily support the required constant and expected load and to overcome and to resist the most adverse storm conditions. Thus, a platform might be engineered to be sufficiently rugged by sheer massiveness to resist hurricane forces at the water surface without collapse or even to avoid excessive damage. The ideal situation would be to design the platforms to safely resist maximum forces as would be instituted by a hurricane or other severe storm. What is more difficult to overcome, however, is the problem instituted by the pulsating forces resulting from periodic wave movement. While such movement may be particularly intense, the periodic forces generated by the waves may be of such frequency that, if counted over a period of time, will prompt and amplify an oscillatory movement of the floor-anchored platform structure. This vibrational tendency will be a function of the platform structure and the intensity and frequency of the wave forces.

While it is possible through engineering techniques to adequately design a platform to overcome the normal and expected wave forces, it is highly impractical in both structural and economical terms to design a platform when vibration and oscillation forces are taken into consideration. It can be readily appreciated that for platforms usable in deep waters the design problems are sharply aggravated as the platform height increases. For example, for extreme depths having an order of magnitude of 400 to 1,000 feet, it is virtually impossible to design and engineer a safe, practical platform. To overcome constantly imposed vibrations or oscillation inducing forces as well as the ordinary natural forces acting against an off-shore platform structure, many expedients have been resorted to such as internal bracing and external anchoring. In the absence of the latter, structures in relatively deep water often utilize an anchoring system including chains and cables both of which elements present troublesome handling problems and are not entirely effective. Furthermore, since the present trend in oil exploratory and production efforts is towards deeper waters, and anchoring systems tend to become more expensive and unwieldly, thereby amplifying the above-noted susceptibility to sway and vibrational tendencies.

An example of one solution of the aforementioned problem is disclosed in U.S. Pat. No. 3,553,968.

SUMMARY OF THE INVENTION

The present invention, which will be described subsequently in greater detail, comprises a dynamic ballast and stabilization system for deep-sea applications wherein a downward vertical thrust is attained by rotating a relatively large multi-vane impellor assembly which includes the means for directing the thrust laterally of the vertical position whereby the system functions to provide a ballast means for anchoring the platform as well as for providing a means for dynamically overcoming any tendencies towards the structure assuming a periodic oscillation which, over a period of time, detrimentally affects the platform.

It is therefore an object of the present invention to provide a new and improved dynamic ballast and stabilization system for off-shore platforms of the type which is firmly anchored to the floor of a desired off-shore location and yet dynamically stabilized to maintain its anchored position while overcoming vibrational tendencies.

Other objects, advantages, and applications of the present invention will become apparent to those skilled in the art of anchoring and stabilizing off-shore platforms when the accompanying description of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the two views, and in which.

DESCRIPTION OF THE PREFERRED EMBODIMENT

Figures 1, 2:
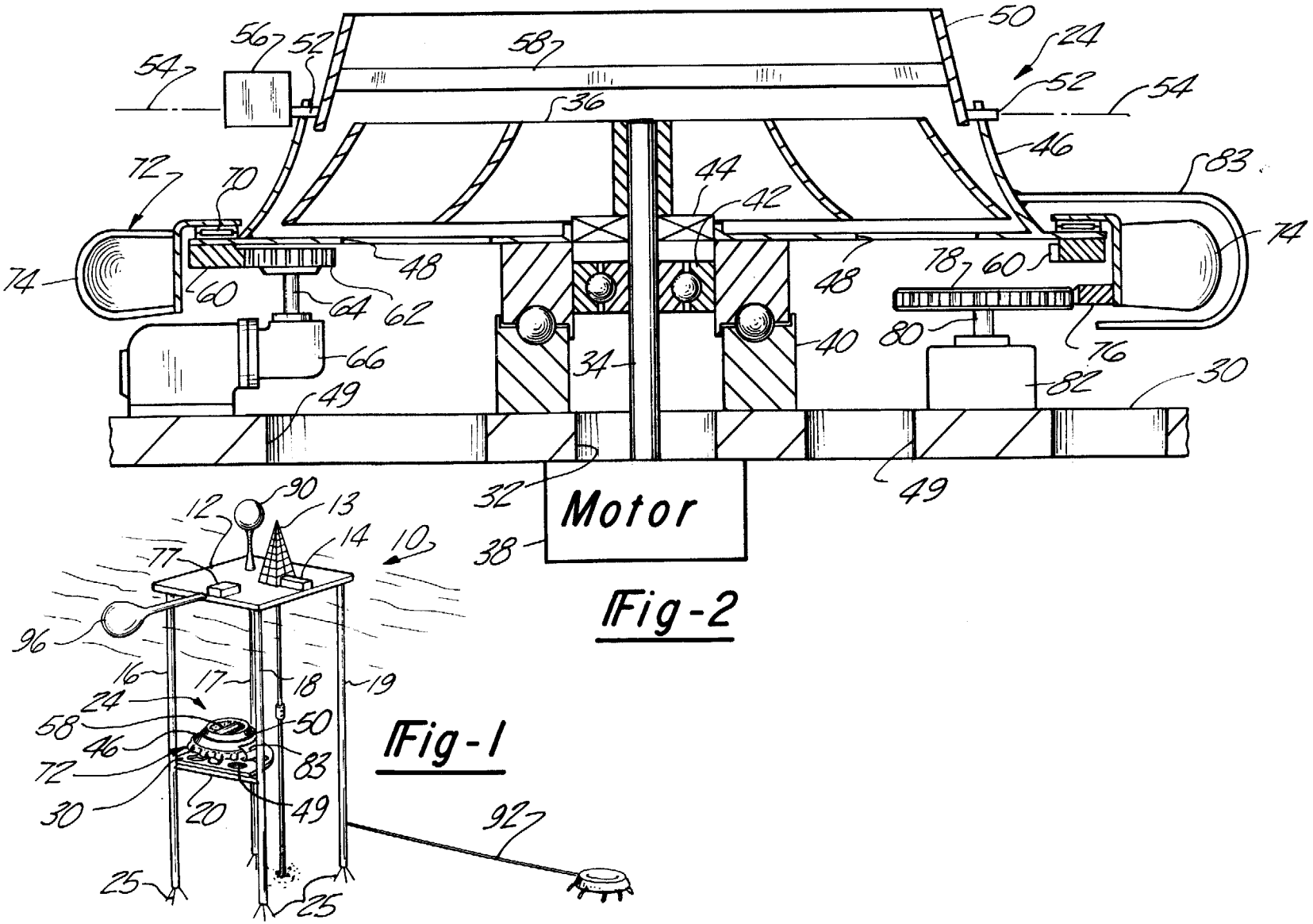
FIG. 1 illustrates an off-shore platform located in a relatively deep body of water and supported by rigidly fixed upright legs.
FIG. 2 is a cross-sectional view of the system which provides dynamic ballast and stabilization of the platform illustrated in FIG. 1.

In achieving the foregoing objectives and overcoming the discussed problems, the present invention contemplates an off-shore platform 10 comprising a working deck 12 holding such equipment as a derrick 13, storage facilities 14, and other equipment which is essential to the proper function of the off-shore drilling or production platform 10. The deck 12 is normally elevated a predetermined distance of about 50–100 feet above the water surface; and thus while the working deck and equipment are essentially beyond the reach of water and waves, they are still subjected to the full effect of surface weather conditions. The deck 12 is sustained in its elevated position above the water surface by an elongated, open structure comprising essentially a plurality of downwardly extending legs 16, 17, 18, and 19 which have their upper ends affixed to the deck 12. The upstanding legs 16, 17, 18, and 19 are reinforced by cross-bracing members 20 which provide rigidity to the structure as well as support for the dynamic ballast and stabilization system 24. The framework structure further includes a plurality of piles 25 which have their lower ends embedded into the ocean floor. The depth of the pile embedment is readily predetermined in accordance with the consistency of the floor of the body of water and the ability of the floor to grip the pile to establish a firm anchor for the structure. This arrangement is just an example of the many types wich may be employed for the mounting and support of such off-shore platforms.

As previously noted, the upright arrangement of the off-shore platform is such that the action of the wind and the waves against the exposed elevated deck 12, as well as against the submerged support structure, tends to urge the bottom anchor laterally and uprightly from its normal disposition. The degree of such displacement will vary with the intensity of the displacing forces and tend to sway or upset the structure about its anchored footings.

A monitoring system should be incorporated into the platform structure to continuously scan, monitor, and interpret the lateral and upward displacement and frequency of movement and displacement of the platform. Such a monitor system would determine the rate of the platform's sway and generate a signal to reflect the interpretation of the received data. The monitor system might include any of several means adaquate to achieve the desired function. For example, the structure may be provided with appropriately placed strain gages which reflect the degree of strain in any particular point in the structure, as the latter is displaced from its normal position. Preferably, the measuring device will be disposed at critical points throughout the entire structure to obtain a more composite set of data with respect to the movement and displacement of the structure. The measuring devices will be connected by means of suitable electric cables to a data assimilator, or computer, mounted in the storage facility 14. The computer would assimilate the information and generate the signal which functions to control the operation of the dynamic ballast and stabilization system 24.

It should be appreciated that the thrust and reacting forces generated by the dynamic ballast and stabilization system 24, as to be described hereinafter, may be embodied in a single reactant, as described, as well as a plurality of separate units. The system 24 comprises a support member 30 which is supported by and attached to the cross-bracing members 20 by any suitable fastening means. The support member 30 has a central aperature 32 through which extends a vertical drive shaft 34 that mounts an impellor 36 at its upper end such that the impellor 36 may be rotated about the vertical axis by the impellor drive shaft 34, as the same is driven by any suitable means such as the electric motor 38. A bearing assembly 40 mounted to the upper surface of the support member 30 functions to provide structural support for a pair of bearings 42 and 44 which respectively provide rotational support for the impellor drive shaft 34 and the impellor 36. The impellor 36 is partially enclosed by a movable slinger or shroud 46 that is rotatably supported by the bearing assembly 40. The slinger 46 has a bottom wall which is aperatured at 48 in a manner similar to aperatures 49 formed in the support member 30 so that seawater may pass, in an unrestricted manner, through the support member 30 and the bottom wall of the slinger 46 such that the impellor may draw the water in and direct the same upwardly at a sufficient rate so as to generate the required reactive force. The slinger which has a truncate shape includes a directional control element 50 which is similarly shaped and mounted to trunnions 52 such that the directional control element 50 may be rotated about the horizontal axis 54 by means of an electric motor 56. It can thus be seen that the water being directed upwardly by the rotating impellor 36 may have its upward direction varied from the vertical by means of the rotational positioning of the directional control element 50 about the horizontal axis 54. A vane member 58 extending across the midsection of the directional control element 50 in conjunction with the inner-wall surface of the directional control element 50 aids in diverting the direction of movement of the water exhausted from the impellor 36. The peripheral edge of the slinger 46 is provided with a gear ring 60 which drivingly meshes with a gear 62 on the end of a drive shaft 64 of an electric motor 66. It can thus be seen that as the electric motor 66 is driven, its out-put shaft 64 rotates the gear 62 so as to rotate the ring gear 60 and the slinger 46. It can thus be seen that as the slinger 46 is rotated about a vertical axis, the direction of movement of the water exhausted from the impellor 36 can be selectively controlled. By utilizing the aforementioned computer in the monitoring system, the position of the movable vane may be controlled by selectively operating the electric motors 56 and 66. Additionally, the rate at which water is exhausted from the impellor 36 and thus the amount of force generated thereby may be also controlled by the rate at which the electric motor 38 drives the impellor 36.

The peripheral edge of the slinger 46 opposite the gear ring 60 mounts a roller bearing 70 which, in turn, rotatably supports a generating wheel 72 in the form of a plurality of arcuately spaced water buckets 74. As can best be seen in FIG. 2, the action of the water passing by the system 10 will engage the buckets 74 and cause the same to rotate about the vertical axis. The water wheel 72 also has a gear ring 76 which engages a gear 78 on the in-put shaft 80 of a generator 82. It can be seen that, as a water wheel 72 is rotated by the action of the underwater currents and the like, its rotational movement will be translated into electrical energy by means of the generator 82. Obviously, a suitable transmission will be provided between the gears 78 and 76 so that a proper coaction between these elements will be achieved, and the generator 82 will function in a desired manner. The generator 82 may preferably be utilized to charge batteries 77 carried on the deck 12 which batteries, in turn, are utilized in conjunction with other electrical generating equipment such as the diesel powered generator to provide the electrical energy necessary for driving the electric motors 38, 66, and 72, as well as the other electrical requirements of the system. The rotatable slinger 46 carries a water wheel guard or shroud 83 which is positioned over a selected number of the buckets 74 so that only the buckets 74 facing the oncoming water flow are exposed. The wheel guard is automatically positioned as the slinger 46 is rotated in the aforementioned manner.

As can best be seen in FIG. 2, water tanks 90 (only one of which is shown) preferably mounted to the upper ends of the legs 16, 17, 18, and 19 are adapted to be filled with seawater to provide static above-water ballast tanks to aid in maintaining the platform in a stable condition. Similarly, outwardly extending cables 92 having one end attached to the legs and the other end anchored some distance from the platform provide additional means for maintaining the legs 16–19 in position on the bottom while helping to maintain a proper alignment between the legs and for maintaining the proper orientation of the thrust generated by the system.

While functioning as ballast the system 24 will force the structure downwardly and will offset the weight loss due to the displacement of water. The vertical load factor can thus be greatly increased simply by rotating the impellor at a greater speed by means of the electric motor 38. With this in mind, it should be noted that the platform 10 and its legs 16, 17, 18, and 19 may be of different constructions employing torsional and/or shock absorbing apparatus such that the deck 12 may be relatively rigid while the legs and other supporting aspects of the structure are more flexible. The system thus reduces the load carrying requirements of the pilings 25 as the strength of the pilings, in order to resist torsional and lateral loads on the structure, are reduced since the structure is more flexible. Since it is more flexible, the platform has a built-in self-righting capability in conjunction with the ballast and stabilizing system 24.

It should be realized that the stabilizing system 24 contains features which, while being disclosed herein, may not always be needed in all applications. For example, the water wheel 72 may not be required if the structure is employed in an area where there is no underwater current. Similarly, the system need not be mounted in a horizontal plane, as illustrated, but may be permanently mounted at an angle that is inclined with respect to the horizontal where known prevailing winds or currents exist and in which the forces generated by such prevailing winds and currents would have to be constantly dealt with.

Additionally, it can be understood that the support system 24 has other applications wherein it may be utilized as a ballast and stabilization system, in particular, wherein an underwater life-support system is desired to be used and maintained on the bottom of the floor of a body of water by means of the system in the same manner in which it is utilized as ballast to maintain the platform structure 10 in a stationary position.

In addition to the water tanks 90 the system may be provided with laterally extending water tanks 96 (only one of which is shown) which are adapted to extend from each side of the deck 12 outwardly from the deck, as shown in FIG. 1. The ballast tanks 96 can be filled with water to provide additional ballast to aid in maintaining the platform in a stable condition; and additionally the tanks 96, as well as the tanks 90, may be provided with suitable valving and the like and piping to interconnect them such that water may be pumped into and out of the tanks as desired so as to shift the weight of water in these tanks and thus control the center of gravity of the platform structure 10. This can be effected by utilizing the aforementioned computer so as to control the disposition of water between the several tanks all of which results in the static tank system being converted into a dynamic ballast system.

It can thus be seen that the present invention has provided a new and improved ballast and stabilization system for platforms particularly adapted for mounting in deep-sea areas.

While only one example of the present invention has been disclosed, it should be understood by those skilled in the art of such ballast and stabilization systems that other forms can be had all coming within the spirit of the invention and scope of the appending claims.

What is claimed is as follows:

1. A dynamic ballast and stabilization system for use in combination with a platform structure anchored at an off-shore location in a body of water, the structure being normally subjected to lateral and upward displacement under the influence of periodically occurring wave forces, said structure including an equipment holding deck, a rigid framework having the upper ends supportably connected to the equipment holding deck with the lower ends thereof fixedly embedded in the floor of said body of water, said system being carried by said framework below the surface of the body of water and comprising:

a support member carried by said framework;

an impellor rotatably carried by said support member, said impellor driving water upwardly to generate a counter-acting force on said support member;

means carried by said support member movable independently of said impellor for controlling direction at which said water is driven; and power generating means carried by said support member and driven by said water, the power generating means being utilized to aid in driving said impellor.

2. The dynamic ballast and stabilization system defined in claim 1 wherein said impellor is driven by an electric motor.

3. The dynamic ballast and stabilization system defined in claim 2 wherein said power generating means comprises a water wheel mounted for rotation about a vertical axis said water wheel being driven by said body of water;

transmission means connecting said water wheel to said generator such that said rotating water wheel drives said generator;

batteries carried by said platform structure and charged by said generator means; and said batteries providing a partial source of the electrical energy needed to drive said electrical motor.

4. The dynamic ballast and stabilization system defined in claim 1 wherein said means carried by said support member for controlling the direction at which water is driven by said impellor comprises a shroud having first member which encircles said impellor and is rotatable about an axis parallel to the axis of rotation of said impellor, and a second member carried by said first member said second member being mounted for pivotal movement about an axis perpendicular to said axis of rotation of said impellor, and means for inclining said second member with respect to its pivotable axis; and means for rotating said first member about the axis of rotation of said impellor.

5. The dynamic ballast and stabilization system defined in claim 4 comprising a second shroud positionable over a portion of said water wheel to protect said water wheel, said second shroud being carried by said rotating first member and automatically positionable over said water wheel when said first member is rotated to position the direction at which fluid is ejected from said impellor.

6. The dynamic ballast and stabilization system defined in claim 4 further comprising a vane element disposed in said second member in the path of said ejected water to aid said second member in controlling the direction of movement of said water as it is exhausted from said rotating impellor.

7. The dynamic ballast and stabilization system defined in claim 1 further comprising ballast tanks carried by said structure above the water level of said body of water and adapted to be filled with said water to provide additional ballast for holding said structure down.

8. The dynamic ballast and stabilization system defined in claim 1 further comprising cable means extending from said structure at a substantial distance therefrom and having anchor means disposed the end of said cables for firmly anchoring said cables into the floor of said body of water to aid said system in maintaining said structure in a secure position.

* * * * *